United States Patent [19]

Beck et al.

[11] 4,060,372

[45] Nov. 29, 1977

[54] SELF-DEFENSE APPARATUS COMPRISING FLASHCUBE LIGHT SOURCE

[76] Inventors: Walter Beck, Hesligenstrasse 8, Kusnacht, Switzerland, 8701; Werner Bürk, Wilhelm Hachtel Str. 13, Musberg, Germany, 7021

[21] Appl. No.: 601,445

[22] Filed: Aug. 4, 1975

[30] Foreign Application Priority Data

Aug. 6, 1974 Germany ..... 2437763

[51] Int. Cl.[2] ..... F21K 5/02

[52] U.S. Cl. ..... 431/93; 362/11

[58] Field of Search ..... 431/93, 94, 95, 95 A; 240/1.3; 222/182, 113; 354/141, 142, 132; 313/113

[56] References Cited

U.S. PATENT DOCUMENTS

| | | | |
|---|---|---|---|
| 1,897,160 | 2/1933 | Endacott | 222/182 |
| 1,930,315 | 10/1933 | Kobayashi | 431/93 |
| 2,024,225 | 12/1935 | Igari | 431/93 |
| 3,035,738 | 5/1962 | Bloom | 222/113 |
| 3,059,135 | 10/1962 | Mineta | 313/113 |
| 3,350,989 | 11/1967 | Toomey | 431/95 |
| 3,537,368 | 11/1970 | Radtke | 354/141 |
| 3,687,034 | 8/1972 | Johnson | 354/142 |
| 3,706,265 | 12/1972 | Simon et al. | 354/132 |
| 3,742,428 | 6/1973 | Rathband | 240/1.3 |
| 3,747,489 | 7/1973 | Brandt et al. | 354/132 |
| 3,770,168 | 11/1973 | Sagarin | 222/182 |
| 3,776,686 | 12/1973 | Anderson et al. | 240/1.3 |
| 3,907,171 | 9/1975 | Pearson | 222/182 |
| 3,947,221 | 3/1976 | Mauser | 431/93 |

FOREIGN PATENT DOCUMENTS

| | | | |
|---|---|---|---|
| 1,512,965 | 3/1967 | France | 354/132 |

*Primary Examiner*—Carlton R. Croyle
*Assistant Examiner*—Thomas I. Ross
*Attorney, Agent, or Firm*— Karl F. Ross

[57] ABSTRACT

A self-defense apparatus has a hand-held housing formed with thin neck adapted to be held between two fingers and provided on its back with a button that when depressed fires one or all of the photoflash lamps of a nonbattery type flash cube. Means is provided for preventing inadvertent actuation of this firing button. The housing is provided on its front end with a transparent lens and inside this lens and surrounding the flash cube with a reflector for directing the flash generated by the flash cube away from the user.

4 Claims, 4 Drawing Figures

SELF-DEFENSE APPARATUS COMPRISING FLASHCUBE LIGHT SOURCE

FIELD OF THE INVENTION

The present invention relates to a self-defense apparatus. More particularly this invention concerns a device for temporarily incapacitating a person without permanently injuring him or her.

BACKGROUND OF THE INVENTION

In recent times devices have been provided for self-defense which serve to temporarily incapacitate a would-be robber or other attacker. The best known and most commonly used such device is a simple tear-gas gun which is very effective at close range for blinding an attacker. The chief disadvantage of this arrangement is that it is effective only at very close range and occasionally poses a hazard for the user when the fumes blow back over him or her. Furthermore accidental discharge of this device in a pocket or pocketbook can be extremely inconvenient.

Other devices such as blank pistols, devices which can administer an electric shock and the like, are also known. All of these devices have shown themselves to be virtually useless in practice and to pose more danger for the user than for the person against whom they are likely to be used.

OBJECTS OF THE INVENTION

It is therefore an object of the present invention to provide an improved self-defense apparatus.

Another object is the provision of such an apparatus presenting no danger whatsoever for the user but being effective for temporarily incapacitating the person against whom it is used.

Yet another object is the provision of such a device which is very simple and can be produced at low cost.

SUMMARY OF THE INVENTION

These objects are attained according to the present invention in a device having a housing in which there is provided a light source capable of generating a flash of light of an intensity to temporarily blind a person. Means is provided on the housing for igniting the light source and causing it to generate at least one such flash.

In accordance with features of this invention the housing is provided with a reflector adjacent the source which directs the flash in a general direction away from the housing. The means for igniting the light source includes a button on the back of the housing that is readily actuatable for the user to direct it for temporarily blinding an attacker or would-be mugger with a burst of light.

According to other features of this invention the light source is a nonbattery-type mechanically actuated flash cube whose four photolamps can be lit either simultaneously or individually. It is also possible in accordance with this invention to use a stroboscope-type arrangement with its own battery.

According to yet another feature of this invention the units, which adapted to be held in the hand, is provided with a safety arrangement that prevents its premature actuation. This arrangement can be a cap that has to be removed to expose the operating button, a lever that must be swung out of the way to expose the button, or a pin that must be removed in order to allow the device to be actuated.

The system according to the present invention can be made at extremely low cost, and can be kept for years before being used, being instantly actuatable at any time. It is capable of emitting an extremely strong blinding flash that will temporarily completely disconcert any attacker or would-be mugger and allow the person using it to escape or summon aid.

BRIEF DESCRIPTION OF THE DRAWING

The above and other objects, features, and advantages will become readily apparent from the following, reference being made to the accompanying drawing in which.

SPECIFIC DESCRIPTION

Figure 1:
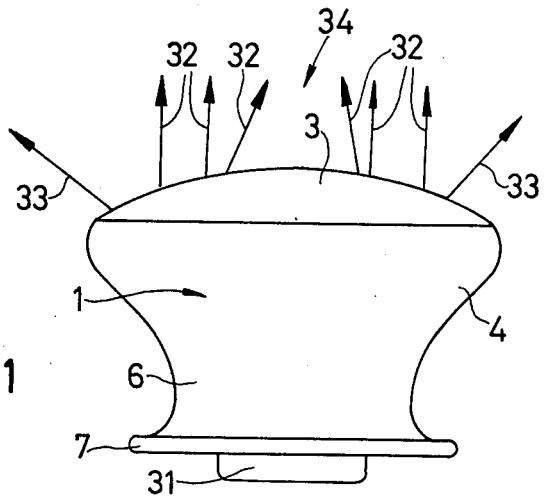
FIG. 1 is a side view of the apparatus in accordance with this invention.
Figure 2:
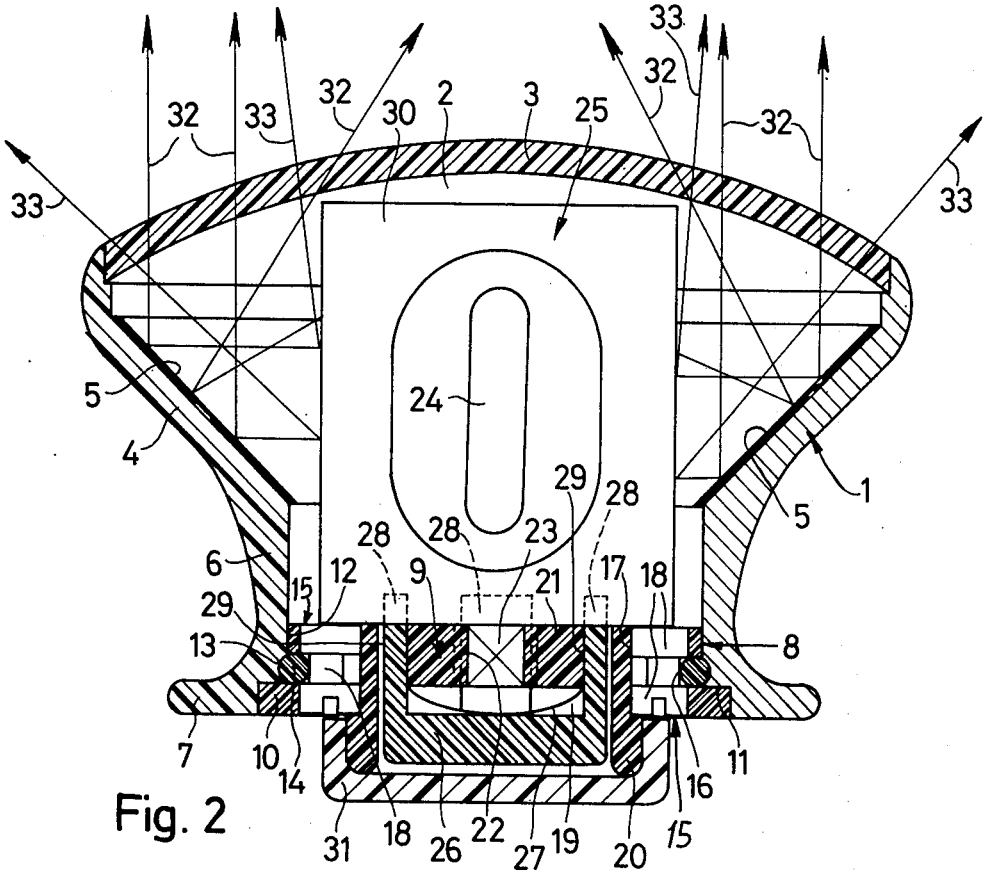
FIG. 2 is a section through the apparatus shown in FIG. 1.

The apparatus according to the present invention as shown in FIGS. 1 and 2 has a housing 1 formed as a body of revolution (i.e. an axially symmetrical body) and defining a closed chamber 2. The front of the housing 1 is covered by a transparent synthetic-resin lens 3 of part-spherical shape, and the adjacent wall part 4 of the housing is provided internally with an annular frustoconical mirror 5 at an angle of 45° to the axis A of revolution of the housing 1. Below this portion 4 the housing has reduced-diameter neck 6 and flares out at 7 so that the user may hold the arrangement between two fingers with the lens 3 pointing away from the user.

The housing has at portions 6 and 7 an open end 8 covered by an end plate 9. A washer 10 is secured in a groove 11 formed at the bottom end of the housing and the inner wall 12 of the housing at the opening 8 is formed with a round-bottom groove 13 in which an O-ring 14 lies. This O-ring 14 lies in a groove formed in the ring 10 and is pressable into the groove 13 by means of four tighteners 15 received in bores 17 in the element 10. Rotation of these elements 15 presses the ring 14 into the groove 13 and secures the element 10 tightly in place inside the open end 8 of the housing 1.

The annular element 10 defines a space 19 and has an axially backwardly extending rim 20. The plate 9 has a central portion 21 formed with a hole 22 into which fits the base pin 23 of a nonbattery flash cube 25 having four identical photoflash lamps such as are described in U.S. Pat. Nos. 3,540,818, 3,540,819 and 3,540,820. A button 26 normally urged away from the flash cube 25 by a leaf spring 27 has four arms 29 terminating in four ends 28 engageable through the envelope 30 of flash cube 25 and with respective actuation wires thereof. A protective cover cap 31 is force-fitted over the rim 9 and readily removable to uncover the end of the operation button 26 and allow the user to press same.

When the button 26 is depressed it will simultaneously fire all four of the photolamps 24 and cause light to be emitted as indicated by arrows 32 so as to form a bright bundle 33 of light that is directed outwardly away from the user and in the general direction of axis A of rotation of the housing 1.

Figure 3:
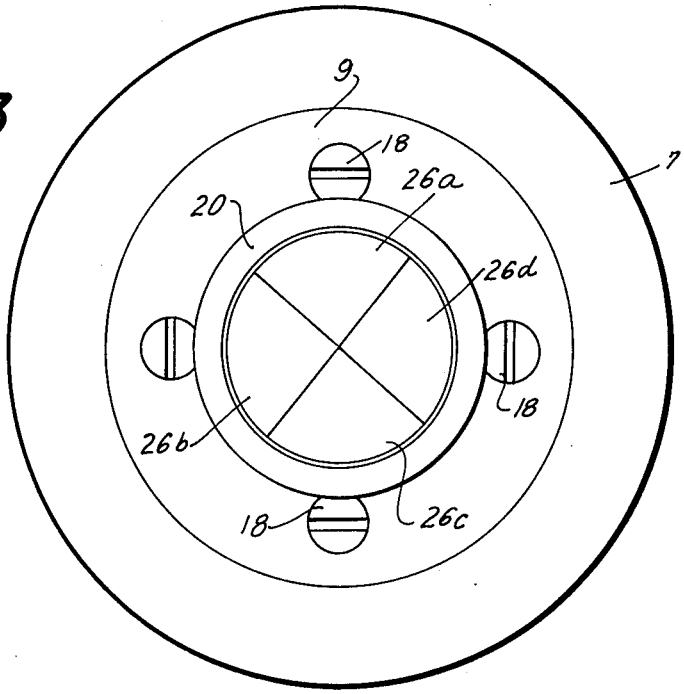
FIG. 3 is a bottom view of an apparatus in accordance with this invention.

It is also possible as shown in FIG. 3 to provide a four-part button having segments *26a–26d* which are individually operable to individually fire the photolamp 24.

Figure 4:
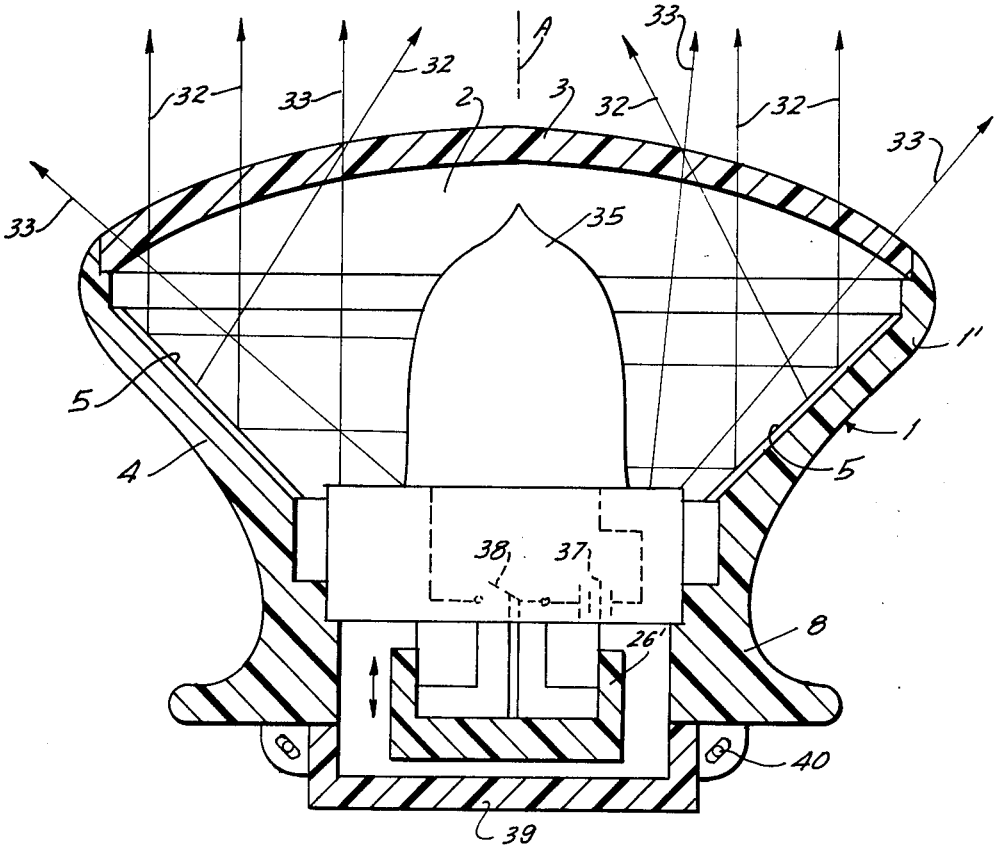
FIG. 4 is a section similar to FIG. 2, illustrating another self-defense apparatus in accordance with the invention.

FIG. 4 shows an arrangement having a housing 1' provided internally with a stroboscope-type photolamp 35 mounted on a power supply 36 provided with a battery 37 and a switch 38. This switch 38 is operable by a button 26' comparable to button 26. In addition the bottom of the housing is provided with a swingable cover 39 held in place by a pin 40 that can be removed so as to allow swinging back of this cover and actuation of the button 26'. In such an arrangement it is possible to achieve literally hundreds of flashes with the same battery prior to replacement thereof.

We claim:

1. A self-defense apparatus comprising:

a housing having a handle on one side dimensioned to be held in the hand;

a flash cube mount in said housing;

a light source on said mount in said housing capable of generating a flash of strength sufficient to temporarily blind a person;

means on said housing for firing said light source and causing same to generate at least one such flash; and a reflector in said housing adjacent said source for directing said flash in a general direction away from said handle, said light source being a four-bulb flash cube and said means being constructed and arranged to fire all of the bulbs of said cube simultaneously.

2. A self-defense apparatus comprising:

a housing dimensioned to be held in the hand;

a flash-cube light source in said housing having a plurality of flash lamps capable of generating flash of strength sufficient to temporarily blind a person; and means on said housing for firing all of said lamps simultaneously, said housing, being axially symmetrical, has a narrow neck adapted to be held between two fingers on the same hand, said means for firing includes a button on one axial end of said housing operable by the thumb of a user of the apparatus, said housing being provided on the opposite end with a transparent lens and wherein said housing is provided internally with a frustoconical mirror tapering away from said lens.

3. The apparatus defined in claim 2, further comprising means displaceable between a first position permitting operation of said means for firing and a second position prevention actuation of said means for firing.

4. The apparatus defined in claim 3, wherein said means displaceable between said positions is a removable cap on said housing.

* * * * *